US010112287B2

(12) United States Patent
Gallagher

(10) Patent No.: US 10,112,287 B2
(45) Date of Patent: Oct. 30, 2018

(54) TUBE CLAMPING HAND TOOL

(71) Applicant: Patrick Gallagher, West Deptford, NJ (US)

(72) Inventor: Patrick Gallagher, West Deptford, NJ (US)

( * ) Notice: Subject to any disclaimer, the term of this patent is extended or adjusted under 35 U.S.C. 154(b) by 48 days.

(21) Appl. No.: 15/217,779

(22) Filed: Jul. 22, 2016

(65) Prior Publication Data

US 2017/0021474 A1 Jan. 26, 2017

Related U.S. Application Data

(60) Provisional application No. 62/195,535, filed on Jul. 22, 2015.

(51) Int. Cl.
*B25B 5/14* (2006.01)
*B25B 7/12* (2006.01)
*B25B 7/02* (2006.01)

(52) U.S. Cl.
CPC ..... *B25B 5/147* (2013.01); *B25B 7/02* (2013.01); *B25B 7/123* (2013.01)

(58) Field of Classification Search
CPC ..... B25B 5/147; B25B 7/123
USPC ..... 81/367
See application file for complete search history.

(56) References Cited

U.S. PATENT DOCUMENTS 1,641,153 A 9/1927 Butt
2,517,041 A 8/1950 Sisley
2,637,236 A 5/1953 Vergnani
3,585,704 A * 6/1971 Schroeder ..... B25B 7/02 269/2
3,709,072 A 1/1973 Rogers
D231,073 S * 4/1974 Woslum ..... D8/55
5,305,669 A * 4/1994 Kimbro ..... B25B 7/00 81/423
7,472,632 B2 1/2009 Engvall
7,530,294 B2 5/2009 Myburgh
2010/0018365 A1* 1/2010 Tyler ..... B25B 5/12 81/423
2010/0031786 A1* 2/2010 Kao ..... B25B 7/02 81/426.5
2011/0302764 A1* 12/2011 Smith ..... B25B 7/02 29/505
2012/0318107 A1* 12/2012 Mann ..... B25B 7/02 81/319

* cited by examiner

*Primary Examiner* — Hadi Shakeri
(74) *Attorney, Agent, or Firm* — Global Intellectual Property Agency, LLC; Daniel Boudwin

(57) ABSTRACT

A handheld clamping tool is provided that is adapted to clamp to and secure rounded work pieces, including lengths of tubing without damaging the same. The tool comprises a locking clamp embodiment and a plyer clamp embodiment, whereby the tool includes a pair of jaws with one or more semicircular apertures therealong that align to form rounded openings when the jaws are brought together. In one embodiment, the tool includes a movable jaw and a fixed jaw, along with a handle and grip that are lockable in a static state. Along the upper portion of the locking embodiment is a vice block in which the locking clamp can be held by a bench vice and the tool can support a tube without interaction by the user. In another embodiment, the tool comprises a pair of handles, a pair of jaws, and a fixed pivot point between the handles.

10 Claims, 3 Drawing Sheets

TUBE CLAMPING HAND TOOL

CROSS REFERENCE TO RELATED APPLICATION

This application claims the benefit of U.S. Provisional Application No. 62/195,535 filed on Jul. 22, 2015. The above identified patent application is herein incorporated by reference in its entirety to provide continuity of disclosure.

BACKGROUND OF THE INVENTION

Field of the Invention

The present invention relates to clamping tools. More specifically, the present invention relates to a hand tool that can be utilized to clamp a tube, pipe, or wire without deforming the work piece once held by the tool.

Provided is a clamp that is particularly suited for clamping and securing piping and other rounded objects without causing damage thereto. The clamp of the present invention is one of a locking clamp or set of plyers that is adapted to removably support a tube work piece. The jaws of the clamp include semi-circular apertures configured to actuate towards one another to form circular apertures adapted for supporting rounded work pieces. The apertures are configured to receive a tube therethrough and clamp therearound.

Among other goals, the present invention is designed to support a length of tube using a handheld clamp, whereby the clamp secures around the rounded exterior of the tube and can secure the same without damaging the tube in the process. The hand tool is an improvement to traditional plyers and locking vice grips, which have jaws that are ill-suited for supporting rounded piping and without damaging the same. When attempting to apply a traditional vice grip or clamp to round piping, the tube can become damaged or distorted when the tube does not fit snugly into the jaws of the clamp. This can cause damage to the work piece and necessitate repairs or replacement. The present invention provides a tool that eliminates the need to carefully clamp tubing, as the tool is suited for supporting rounded tubing with specifically designed jaws for the task. Overall, the present invention provides a new and useful hand tool for residential and commercial use.

SUMMARY OF THE INVENTION

The following summary is intended solely for the benefit of the reader and is not intended to be limiting in any way. The present invention provides a new clamping hand tool that can be utilized for providing convenience for the user when clamping rounded work pieces and sections of tube or pipe.

It is therefore an object of the present invention to provide a new and improved clamping hand tool that has all of the advantages of the prior art and none of the disadvantages.

It is another object of the present invention to provide a clamping hand tool that comprises one of a locking clamp or a pair of pliers that are designed to hold a rounded work piece, such as a tube or pipe, without damaging the cross section thereof.

Another object of the present invention is to provide a clamping hand tool in which the tool is a locking clamp. The tool comprises a handle having an elongated length, a proximal end, and a distal end. The tool additionally has a grip with an elongated length, a proximal end, and a distal end. Along the working end of the tool is a fixed jaw extending from the distal end of the handle, and a movable jaw pivotably connected to the handle between the distal end of the handle and the fixed jaw. The grip moves the movable jaw towards the fixed jaw when the grip is pressed toward the handle. The jaws clamp a work piece therebetween.

Another object of the present invention is to provide a locking clamp whereby the movable jaw is pivotably connected to the distal end of the grip, and an intermediate link with first end and a second end is pivotably and slidably connected to the handle at a position along the length of the handle. The opposite end of the intermediate link is pivotably connected to the grip along the length of the grip. Together with a turn screw and bias spring disposed within the handle, the intermediate link locks the grip relative to the handle and thus locks the movable jaw into a static state relative to the fixed jaw.

Another object of the present invention is to provide a locking clamp whereby a distal end of the turn screw is adapted to secure to the first end of the intermediate link when the grip is moved toward the handle. The turn screw is adapted to adjust the position of the first end of the intermediate link along the length of the handle and operably lock the first end of the intermediate link to the handle when the grip is moved toward the handle.

Another object of the present invention is to provide a locking clamp whereby a release link is pivotably connected to the grip, the release link having a distal end that is adapted to engage the intermediate link and release the first end of the intermediate link from the distal end of the turn screw.

Another object of the present invention is to provide a locking clamp whereby the fixed jaw has a semicircular aperture adapted to receive a rounded work piece therein, and the movable jaw has a semicircular aperture adapted to receive a rounded work piece therein. Together, semicircular aperture of the fixed jaw and the semicircular aperture of the movable jaw align to form complimentary pairs of a rounded opening when the movable jaw is pressed against the fixed jaw.

Another object of the present invention is to provide a locking clamp wherein the rounded opening further comprises a circular opening with a constant radius.

Another object of the present invention is to provide a locking clamp wherein the rounded opening further comprises a enclosed opening with a continuous perimeter when the movable jaw is pressed against the fixed jaw.

Another object of the present invention is to provide a locking clamp wherein the fixed jaw has a plurality of semicircular apertures adapted to receive a rounded work piece therein. The movable jaw has a plurality of semicircular apertures adapted to receive a rounded work piece therein, whereby semicircular apertures of the fixed jaw and the semicircular apertures of the movable jaw align to form complimentary pairs of rounded openings when the movable jaw is pressed against the fixed jaw.

Another object of the present invention is to provide a locking clamp wherein each of the complimentary pairs of rounded openings have different open areas to accommodate workpieces of different size in each of the rounded openings.

Another object of the present invention is to provide a handheld clamping tool that comprises a first handle, a second handle, a first jaw, a second jaw, and a pivot point therebetween. The first handle is pivotably connected to the second handle at the pivot point such that the first jaw and second jaw are pressed together when the first handle and second handle are rotated relative to the pivot point.

Another object of the present invention is to provide a handheld clamping tool wherein the first handle has an elongated length, a proximal end, and a distal end, while the second handle also has an elongated length, a proximal end, and a distal end.

Another object of the present invention is to provide a handheld clamping tool whereby the first jaw extends from the distal end of the first handle, and the second jaw extends from the distal end of the second handle.

Another object of the present invention is to provide a handheld clamping tool whereby the first jaw has a semicircular aperture adapted to receive a rounded work piece therein, while the second jaw also has a semicircular aperture adapted to receive a rounded work piece therein. Together, the semicircular aperture of the first jaw and the semicircular aperture of the second jaw align to form complimentary pairs of a rounded opening when the first jaw and second jaw are pressed together.

Another object of the present invention is to provide a handheld clamping tool wherein the rounded opening further comprises a circular opening with a constant radius.

Another object of the present invention is to provide a handheld clamping tool wherein the rounded opening further comprises an uninterrupted perimeter when the first jaw and second jaw are pressed together.

Another object of the present invention is to provide a handheld clamping tool wherein the first jaw has a plurality of semicircular apertures adapted to receive a rounded work piece therein, and the second jaw has a plurality of semicircular apertures adapted to receive a rounded work piece therein. Together, the semicircular apertures of the first jaw and the semicircular apertures of the second jaw align to form complimentary pairs of rounded openings when the first jaw and second jaw are pressed together.

Another object of the present invention is to provide a handheld clamping tool wherein each of the complimentary pairs of rounded openings have different open areas to accommodate workpieces of different size in each of the rounded openings.

Another object of the present invention is to provide a handheld clamping tool in which the handle further comprises a clamping block therealong that provides purchase area for a third party clamping tool to support the handle.

Another object of the present invention is to provide a handheld clamping tool in which the handle further comprises a clamping block having a rectangular cross section therealong and along an upper surface thereof, whereby the clamping block provides purchase area for a third party clamping tool to support the handle.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
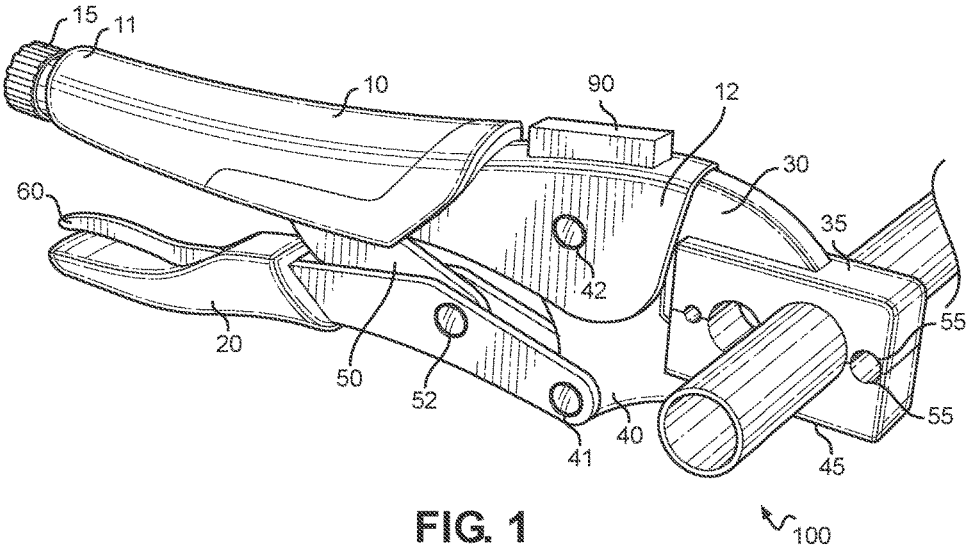
FIG. 1 shows a view of the handheld clamping tool of the present invention in a working state, supporting a rounded tube between its fixed and movable jaw.

Reference is made herein to the attached drawings. Like reference numerals are used throughout the drawings to depict like or similar elements of the handheld clamping tool of the present invention. For the purposes of presenting a brief and clear description of the present invention, the preferred embodiment will be discussed as used for clamping a rounded work piece without damaging the work piece. The figures are intended for representative purposes only and should not be considered to be limiting in any respect.

Figure 2:
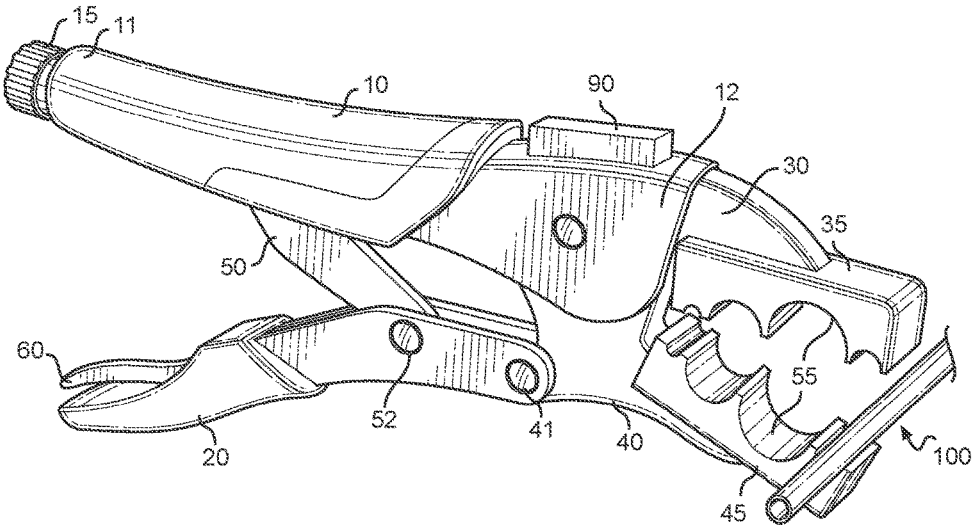
FIG. 2 shows another view of the handheld clamping tool of the present invention.

Referring now to FIGS. 1 and 2, there are shown views of the handheld clamping tool of the present invention. The clamping tool is one that is designed to clamp and secure a work piece within its working end, and more specifically secure a rounded work piece 100 such as a tube or pipe. The working end of the tool has a pair of jaws that clamp the rounded work piece 100 without deforming the cross section of the work piece 100 or otherwise damaging its shape. In this way, the clamp is an improvement over standard pliers and locking clamps that are not conformal to a rounded work piece and thus have the ability to compress the work piece and deform its shape.

In one embodiment, the handheld clamping tool comprises a locking clamp construction, whereby the tool can clamp a rounded work piece 100 and maintain its grip thereon without continued pressure by the user. In another embodiment, the handheld clamping tool comprises a set of pliers or a standard hand clamp that requires consistent pressure by the user to maintain grip of the work piece 100. Referring to FIGS. 1 through 4, there are shown views of an embodiment of the locking clamp.

The locking clamp comprises a handle 10 having an elongated length, a proximal end 11, and a distal end 12. Adjacent to the handle 10 is a moveable grip 20 having an elongated length, a proximal end, and a distal end 41. The handle 10 and grip 20 are used to control the position of a fixed jaw 35 and a movable jaw 45, respectively. The fixed jaw 35 extends from the distal end 30 of the handle, while the movable jaw 45 is pivotably connected 42 to the handle 10 along its length and between the distal end 30 and the fixed jaw 35 of the handle 10. Furthermore, the movable jaw 45 is pivotably connected to the distal end 41 of the grip 20, whereby the movable jaw 45 includes a body portion 40 and two pivot points 41, 42, the pivot points connected to the handle 10 and the grip 20. Finally, an intermediate link 50 is disposed between the handle 10 and the grip 20. When the grip 20 is moved relative to the handle 10, the body 40 of the movable jaw 45 pivots about its two pivot points 41, 42 and moves the movable jaw 45 towards or away from the fixed jaw 35 depending on the direction of motion of the grip 20.

Figure 3:
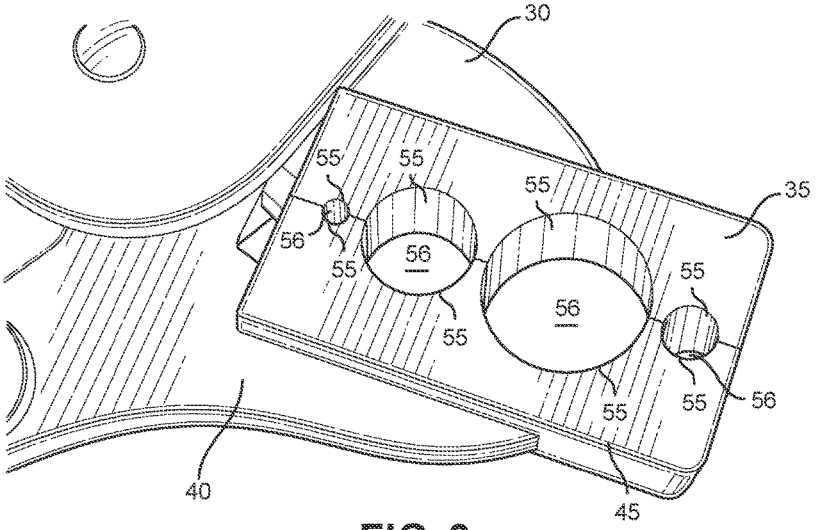
FIG. 3 shows a view of the fixed and movable jaws of the handheld clamping tool pressed together to form rounded openings.
Figure 4:
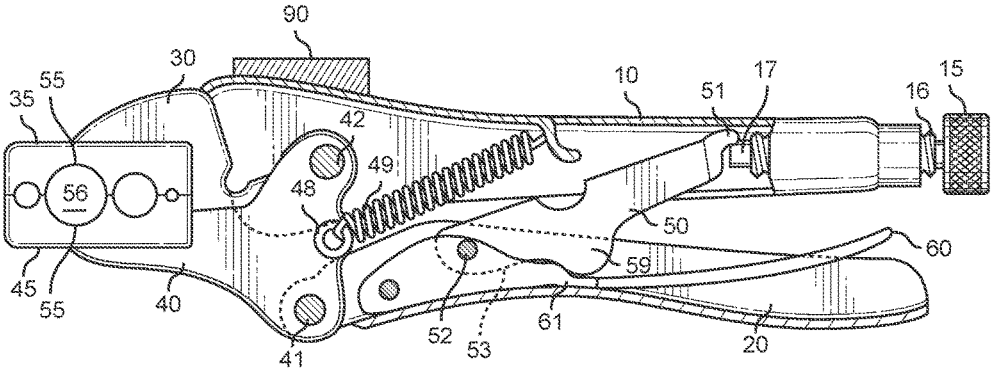
FIG. 4 shows a cross section view of an embodiment of the handheld clamping tool, whereby the tool comprises a locking clamp.
Figure 5:
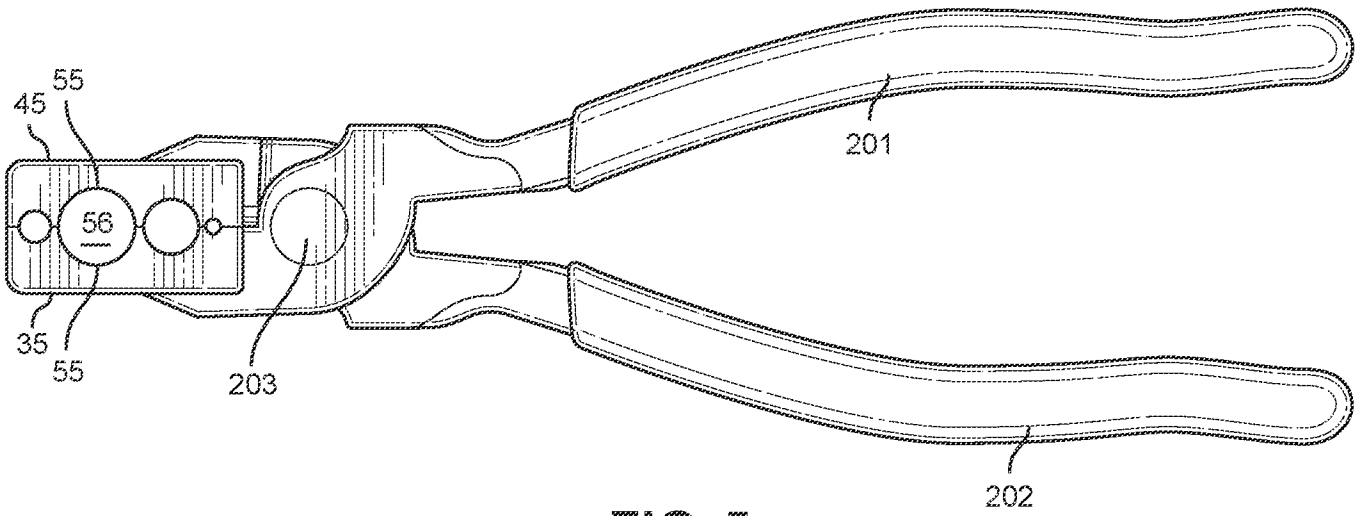
FIG. 5 shows a side view of an embodiment of the handheld clamping tool, whereby the tool comprises a plier tool.

The jaws of the tool are suited for securing a rounded work piece therebetween when the jaws are moved towards one another using the handle 10 and grip 20. In particular, the fixed jaw 35 has an interior surface that faces the interior surface of the moveable jaw 45. Disposed along the interior surfaces of the jaws are one or more series of semicircular apertures 55, each semicircular apertures 55 of the jaws being aligned with one another when the interior surfaces of the jaws are pressed together to form rounded openings 56 through the jaws when in a closed state, as shown in FIG. 3. The semicircular apertures 55 are rounded surfaces extending inward into the jaw from the interior surface of the jaw. The apertures 55 are adapted to conform to the outer surface of a rounded work piece 100 and receive the same therein. As shown in FIGS. 1 through 4, the movable jaw 45 and the fixed jaw 55 each has at least one semicircular aperture 55 adapted to receive a rounded work piece therein. Together, the semicircular apertures 55 of the fixed jaw 35 and the semicircular apertures 55 of the movable jaw 45 align to form complimentary pairs of one or more rounded openings 56 when the movable jaw 45 is pressed against the fixed jaw 35. In this way, the rounded surfaces of each jaw bear against the rounded outer profile of the work piece 100, and preferably are sized to clamp therearound when the jaws are pressed together. This is accomplished without compressing or deforming the profile of the work piece when the correct size opening 56 is used to support a particular diameter work piece.

In the locking clamp embodiment, the movable jaw 45 can be fixed in a static position relative to the fixed jaw 35. This is accomplished using the movable jaw body 40 and its upper pivot points 42 at the handle 10 and its lower pivot point 41 at the grip 20. Extending between the grip 20 and the handle 10 is the intermediate link 50. The intermediate link 50 has a first end 51 and a second end 52. The first end 51 is pivotably and slidably connected to the handle 10 at a position along the length of the handle 10, while the second end 52 is pivotably connected to the grip 20 along the length of the grip 20. A turn screw 16 is disposed within the proximal end of the handle 10, whereby a distal end 17 of the turn screw 16 is adapted to secure to the first end 51 of the intermediate link 50 when the grip 20 is moved toward the handle 10. The distal end 17 of the turn screw 16 engages the first end 51 of the intermediate link 50 and sets the rearmost position along the handle 10 the first end 51 of the link 50 may travel. Therefore, the turn screw 16 position sets a rear wall against which the first end 51 of the link 50 bears against when the grip 20 is pulled toward the handle 10. Depending on the position of the distal end 17 of the screw 16, the body 40 of the movable jaw 45 will rotate to a final position that is flushly against the fixed jaw 35 or at a defined distance offset therefrom.

The final position of the movable jaw when the grip 20 is pulled toward the handle 20, and therefore the final position of the grip 20, is maintained by way of a bias spring 49 between the body 40 of the movable jaw 45 and the handle 10. The bias spring 49 maintains tension on the body 40 of the moveable jaw 45 at a position 48 between the first 41 and second 42 pivot points. The bias spring also draws the intermediate link 50 against the turn screw distal end 17. The final position of the movable jaw 45 is therefore determined by the turn screw 16, which can be adjusted using a turn knob 15 at the proximal end of the handle 10.

Along the interior of the grip 20 is a release link 60 pivotably connected to the grip 60. The release link 60 is one that is adapted to bear against the intermediate link 50 to release the first end 51 thereof from the distal end 17 of the turn screw 16. The release link 60 engages the intermediate link 50 along the length of the intermediate link 50 and rotates the intermediate link upwards from the grip 20 thereby lifting the first end 51 of the intermediate link 50 from the turn screw 16. When the release link 60 releases the intermediate link 50 from the turn screw 16, the grip 20 can be freely rotated relative to the handle 10, and the moveable jaw 45 can be rotated relative to the fixed jaw 35.

Overall, the fixed jaw 35 and the movable jaw 45 each has one or more semicircular apertures 55 therealong, which are adapted to receive a rounded work piece therein. Together, the semicircular apertures 55 of the fixed jaw 35 and the semicircular aperture 55 of the movable jaw 45 align to form complimentary pairs of a rounded opening 56 when the movable jaw 45 is pressed against the fixed jaw 35. The rounded openings 56 may circular openings with a constant radius, oblong openings, or otherwise. Moreover, the rounded openings 56 may also form enclosed opening with a continuous perimeter when the movable jaw 45 is pressed against the fixed jaw 35. Finally, each of the complimentary pairs of rounded openings 56 may have different open areas (i.e. open cross sections for receiving a specifically sized work piece) to accommodate workpieces of different size in each of the rounded openings.

While the jaws allow for the clamping of a rounded work piece without damaging the same, the locking clamp elements of the tool allow the tool to clamp a work piece while the user releases his or her grip on the tool. The locking clamp elements ensure the clamp retains its grip on the work piece. Being able to clamp a work piece and release manual pressure thereon is important for several tasks. When cutting, soldering, or otherwise working with the work piece, it may be necessary to have both hands free from the tool while the tool handles the work piece.

To further this ability, the handle 10 further comprises a clamping block 90 therealong that provides purchase area for a third party clamping tool to support the handle 10 and the tool while in use. The clamping block 90 is a raised protrusion that extends above the upper surface of the handle 10 and allows a vice tool, table vice, or other support to grip the block 90 (i.e. obtain purchase thereof) and support the same while the tool supports a rounded work piece between its jaws. Rather than have the third party vice tool directly grip the work piece, the jaws of the present invention support the work piece without damaging it, while the third party vice tool supports the tool of the present invention. This allows hands free support of a rounded work piece. The clamping block 90 may comprises a rectangular cross section extending upwards from the handle 90, whereby the block is a solid member suited to be clamped by a vice tool.

In addition to a clamping embodiment, the present invention also contemplates a plier tool embodiment. In this embodiment, the handheld clamping tool comprises a first handle 201, a second handle 202, and a pivot point 203 therebetween. Each handle 201, 202 has an elongated length, a proximal end, and a distal end. The first handle 201 has a first jaw 35 extending from the distal end thereof. The second handle 202 has a second jaw 45 extending from the distal end thereof. The first handle 201 is pivotably connected to the second handle 202 at the pivot point 203 such that the first jaw 35 and second jaw 45 are pressed together when the first handle 201 and second handle 202 are rotated relative together about the pivot point 203.

Each of the jaws has an inner surface. Each inner surface further comprises one or more semicircular apertures 55 as provided in the clamping tool embodiment. Each of the semicircular apertures 55 is adapted to receive a rounded work piece therein. Together, the semicircular apertures 55 of the first jaw 201 and the semicircular apertures 55 of the second jaw 202 align to form complimentary pairs of rounded openings 56 when the first jaw 201 and second jaw 202 are pressed together. The rounded openings 56 may further comprise circular openings, each with a constant radius, or alternatively the rounded openings may have oblong or ellipse shape. Furthermore, each of the rounded openings may comprise an enclosed opening with a continuous perimeter when the first jaw 35 and second jaw 45 are pressed together. Finally, each jaw may include several semicircular apertures 55 therealong, each corresponding to a different size work piece. In this way, each rounded opening has a different open area to accommodate workpieces of different size along the jaws when closed together.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handheld clamping tool, comprising:

a handle having an elongated length, a proximal end, and a distal end;

a grip having an elongated length, a proximal end, and a distal end;

a fixed jaw extending from the distal end of the handle defining a body having opposite side surfaces and a work piece securing portion;

a movable jaw pivotably connected to the handle between the distal end of the handle and the fixed jaw defining a body having opposite side surfaces and a work piece securing portion;

whereby the work piece securing portion of the fixed jaw and the work piece securing portion of the movable jaw align to form a substantially rectangular block having a thickness greater than a thickness of each of the body when the movable jaw is pressed against the fixed jaw;

whereby the movable jaw is pivotably connected to the distal end of the grip;

an intermediate link having a first end and a second end;

the first end of the intermediate link being pivotably and slidably connected to the handle at position along the length of the handle;

the second end of the intermediate link being pivotably connected to the grip along the length of the grip;

a turn screw disposed within the handle, whereby a distal end of the turn screw is adapted to secure to the first end of the intermediate link when the grip is moved toward the handle;

whereby the turn screw is adapted to adjust the position of the first end of the intermediate link along the length of the handle and operably lock the first end of the intermediate link to the handle when the grip is moved toward the handle;

a bias spring disposed between the handle and movable jaw;

a release link pivotably connected to the grip, the release link being adapted to engage the intermediate link and release the first end of the intermediate link from the distal end of the turn screw;

whereby the fixed jaw has a plurality of semicircular apertures formed in the work piece securing portion, adapted to receive a rounded work piece therein;

whereby the movable jaw has a plurality of semicircular apertures formed in the work piece securing portion, adapted to receive a rounded work piece therein;

whereby the plurality of semicircular apertures of the fixed jaw and the plurality of semicircular apertures of the movable jaw align to form a plurality of rounded openings when the movable jaw is pressed against the fixed jaw;

wherein each rounded opening defines a fixed and integral smooth interior surface, each rounded opening configured to receive a rod therein;

wherein a portion of the fixed jaw and a portion of the movable jaw extend beyond the distal end of the handle such that at least one rounded opening is disposed entirely beyond the distal end of the handle;

wherein each rounded opening extends from beyond each of said side surface of the fixed and the movable jaw defined by the thickness of the substantially rectangular block; and wherein four rounded openings are defined, such that a second rounded opening is larger than a proximally disposed first rounded opening, a third rounded opening is distal to and larger than the second rounded opening, and a fourth rounded opening is smaller than and distal to the third rounded opening.

2. The handheld clamping tool of claim 1, wherein the plurality of rounded openings further comprise a plurality of circular openings with constant radiuses.

3. The handheld clamping tool of claim 1, wherein the plurality of rounded openings further comprise a plurality of enclosed openings with continuous perimeters when the movable jaw is pressed against the fixed jaw.

4. The handheld clamping tool of claim 1, wherein: each of the rounded openings defines a different open area to accommodate a workpiece of a different size in each of the rounded openings.

5. The handheld clamping tool of claim 1, wherein: the handle further comprises a clamping block disposed on an upper surface thereof, configured to provide purchase area for a third party clamping tool to support the handle.

6. The handheld clamping tool of claim 1, wherein:

the handle further comprises a clamping block having a rectangular cross section therealong and along an upper surface thereof, whereby the clamping block provides purchase area for a third party clamping tool to support the handle.

7. A handheld clamping tool, comprising:

a first handle having an elongated length, a proximal end, and a distal end;

a second handle having an elongated length, a proximal end, and a distal end;

a first jaw extending from the distal end of the first handle defining a body having opposite side surfaces and a work piece securing portion;

a second jaw extending from the distal end of the second handle defining a body having opposite side surfaces and a work piece securing portion;

whereby the work piece securing portion of the first jaw and the work piece securing portion of the second jaw align to form a substantially rectangular block having a thickness greater than a thickness of each of the body when the second jaw is pressed against the first jaw;

the first handle being pivotably connected to the second handle at a pivot point such that the first jaw and second jaw are pressed together when the first handle and second handle are rotated relative to the pivot point;

whereby the first jaw has a plurality of semicircular apertures formed in the work piece securing portion, adapted to receive a rounded work piece therein;

whereby the second jaw has a plurality of semicircular apertures formed in the work piece securing portion, adapted to receive a rounded work piece therein;

whereby the plurality of semicircular apertures of the first jaw and the plurality of semicircular apertures of the second jaw align to form a plurality of rounded openings when the first jaw and second jaw are pressed together;

wherein rounded opening defines a fixed and integral smooth interior surface, each rounded opening configured to receive a rod therein;

wherein a portion of the first jaw and a portion of the second jaw extend beyond the distal end of each of the first handle and second handle such that at least one rounded opening is disposed entirely beyond the distal end of each of the first handle and second handle;

wherein each rounded opening extends from beyond each of said side surface of the first jaw and the second jaw defined by the thickness of the substantially rectangular block; and wherein four rounded openings are defined, such that a second rounded opening is larger than a proximally disposed first rounded opening, a third rounded opening is distal to and larger than the second rounded opening, and a fourth rounded opening is smaller than and distal to the third rounded opening.

8. The handheld clamping tool of claim 7, wherein each rounded opening further comprises a circular opening with a constant radius.

9. The handheld clamping tool of claim 7, wherein each rounded opening further comprises an enclosed opening with a continuous perimeter when the first jaw and second jaw are pressed together.

10. The handheld clamping tool of claim 7, wherein: each of the complimentary pairs of rounded opening has a different open area to accommodate a workpiece of a different size.

* * * * *